United States Patent [19]

Cooper et al.

[11] Patent Number: 4,490,194

[45] Date of Patent: Dec. 25, 1984

[54] EMULSION EXPLOSIVE COMPOSITION

[75] Inventors: John Cooper, Ayrshire, Scotland; Colin A. Mumme-Young, Chester, England

[73] Assignee: Imperial Chemical Industries PLC, London, England

[21] Appl. No.: 515,872

[22] Filed: Jul. 21, 1983

[30] Foreign Application Priority Data

Jul. 21, 1982 [GB] United Kingdom ..... 8221038

[51] Int. Cl.[3] ..... C06B 45/00

[52] U.S. Cl. ..... 149/2; 149/21; 149/44; 149/45; 149/46; 149/61; 149/76; 149/83; 149/85; 149/92; 149/105

[58] Field of Search ..... 149/2, 21, 44, 45, 46, 149/61, 76, 83, 85, 92, 105

[56] References Cited

U.S. PATENT DOCUMENTS

| | | | |
|---|---|---|---|
| 4,141,767 | 2/1979 | Sudweeks et al. | 149/21 |
| 4,216,040 | 8/1980 | Sudweeks et al. | 149/21 |
| 4,394,198 | 7/1983 | Takeuchi et al. | 149/21 |

FOREIGN PATENT DOCUMENTS

| | | |
|---|---|---|
| 19458 | 5/1980 | European Pat. Off. . |
| 28908 | 5/1981 | European Pat. Off. . |
| 1335097 | 10/1973 | United Kingdom . |
| 1557917 | 12/1979 | United Kingdom . |
| 2042495 | 9/1980 | United Kingdom . |
| 2050340 | 1/1981 | United Kingdom . |
| 2058740 | 4/1981 | United Kingdom . |

*Primary Examiner*—Stephen J. Lechert, Jr.

*Attorney, Agent, or Firm*—Cushman, Darby & Cushman

[57] ABSTRACT

An emulsion explosive composition comprising a discontinuous phase containing an oxygen-supplying phase wherein the discontinuous phase additionally comprises a crystal growth-inhibitor. The compositions exhibit improved storage characteristics.

13 Claims, No Drawings

EMULSION EXPLOSIVE COMPOSITION

This invention relates to an explosive composition and, in particular, to an emulsion explosive composition of the kind comprising a discontinuous oxidiser phase dispersed throughout a continuous fuel phase which is substantially immiscible with the discontinuous phase.

Commercially available emulsion explosive compositions generally comprise an external or continuous organic fuel phase in which discrete droplets of an aqueous solution of an oxygen-supplying source are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916 and 4,149,917.

For certain applications the water content of the oxidiser phase of the emulsion explosive may be completely eliminated or at least reduced to a low level—for example, to less than 4% by weight of the total emulsion composition. Such compositions are conventionally referred to as melt-in-oil or melt-in-fuel emulsion explosives and have been described, inter alia, in U.S. Pat. No. 4,248,644.

Formation of an emulsion explosive composition is generally effected in the presence of a surface tension-modifying emulsifier selected to promote subdivision of the droplets of the oxidiser phase and dispersion thereof in the continuous phase. In addition, the emulsifier is believed to exist as a molecular coating layer on the surface of the droplets thereby to reduce incipient breakdown of the emulsion by inhibiting coalescence and agglomeration of the droplets.

The droplets of the oxidiser phase are inherently metastable and exhibit a tendency to crystallise. Growth of the resultant crystals tends to impair the sensitivity to detonation of the emulsion explosive compositions, and attendant interlocking of the crystal matrices renders the compositions solid and, therefore, difficult to prime. Conventional emulsion explosive compositions therefore generally exhibit a progressive deterioration of explosive performance resulting from the ageing process which occurs during the storage and or transporting period elapsing between manufacture and eventual use of the explosive.

Various attempts to improve the storage characteristics of emulsion explosive compositions have hitherto concentrated on the emulsifier component of the compositions and, in particular, on the selection of suitable emulsifiers, or blends thereof, which are designed to suppress coalescence of the supersaturated droplets of the oxidiser salt present in the discontinuous phase. Thus it has been proposed in British patent specification GB No. 2 042 495A to provide a water-in-oil emulsion blasting composition having as the sole emulsifier an organic cationic emulsifier comprising a hydrophilic portion and a lipophilic portion, the latter being an unsaturated hydrocarbon chain. The unsaturated emulsifier may be a fatty acid amine or ammonium salt having a chain length of from 14 to 22 carbon atoms and is said to function as a crystal habit modifier to control and limit the growth of crystals in the oxidiser salt solution. However, such emulsion explosive compositions are relatively insensitive to detonation (not cap sensitive—i.e. incapable of detonation by a detonator of magnitude less than a standard No. 8 detonator) and, as prepared, have critical diameters (below which cartridges filled with the composition will not detonate) of the order of 19 mm. The compositions are therefore reliably effective and of commercial utility as blasting agents only in cartridges having a diameter of at least 25 mm. Smaller critical diameter utility is achieved only by the inclusion in the compositions of a significant proportion of a eutectic-forming salt, such as calcium nitrate, which reduces the amount of gas generated on detonation and therefore adversely affects the explosive performance.

Likewise, it has been proposed in British patent specification GB No. 2 050 340A to employ an emulsifying agent comprising a specific blend of a conventional water-in-oil emulsifier and at least one amphiphatic synthetic polymeric emulsifier. If desired, the specified blend of emulsifiers may be supplemented by a further emulsifier, such as alkyl naphthalene sodium sulphonate, which is said to act as a crystal habit modifier for the oxidiser salt.

We have now devised a cap sensitive emulsion explosive composition exhibiting improved explosive performance and storage stability, and not requiring the presence of an expensive, supplementary emulsifier.

Accordingly, the present invention provides an emulsion explosive composition comprising a discontinuous phase containing an oxygen-supplying salt component and an organic medium forming a continuous phase characterised in that the discontinuous phase additionally comprises an inhibitor capable of at least partially restricting growth and/or modifying the habit of crystals of the oxygen-supplying salt component.

The invention further provides a process for producing an emulsion explosive composition comprising emulsifying an oxygen-supplying salt component and an organic medium in the presence of an emulsifier to form an emulsion in which the salt forms at least part of the discontinuous phase and the organic medium forms at least part of the continuous phase characterised in that the discontinuous phase additionally comprises an inhibitor capable of at least partially restricting growth and or modifying the habit of crystals of the oxygen-supplying salt component.

The oxygen-supplying salt component of the discontinuous phase suitably comprises any oxidiser salt capable of releasing oxygen in an explosive environment in an amount and at a rate sufficient to confer acceptable explosive characteristics on the emulsion composition. Inorganic oxidiser salts conventionally employed in the production of emulsion explosive compositions, and suitable for inclusion in the compositions of the present invention, are disclosed, for example, in U.S. Pat. No. 3,447,978 and include ammonium salts and salts of the alkali- and alkaline-earth metals—such as the nitrate, chlorate and perchlorate salts, and mixtures thereof. Other suitable salts include hydrazine nitrate and urea perchlorate.

Ammonium nitrate is preferably employed as a primary oxidiser salt comprising at least 50% by weight of the oxygen-supplying salt component, supplemented, if desired, by a minor (not exceeding 50% by weight) amount of a secondary oxidiser component, such as calcium nitrate or sodium nitrate. A secondary oxidiser component may be incorporated into an aqueous discontinuous phase but its presence is particularly desirable if the oxygen-supplying salt component is to be incorporated into the emulsion in the form of a melt, i.e. in the substantial or complete absence of water from the discontinuous phase. Suitable secondary oxidiser components which form an eutectic melt when heated together with ammonium nitrate include inorganic oxidiser salts of the kind hereinbefore described, such as the nitrates of lead, silver, sodium and calcium, and organic compounds, such as mono- and poly-hydroxylic compounds including methanol, ethylene glycol, glycerol, mannitol, sorbitol and pentaerythritol, carbohydrates, such as glucose, sucrose, fructose and maltose, aliphatic carboxylic acids and their derivatives, such as formic acid and formamide, and organo-nitrogen compounds, such as urea, methylamine nitrate and hexamethylene tetramine, and mixtures thereof.

If desired, the discontinuous phase may additionally comprise a solid oxidiser component, such as solid ammonium nitrate—conveniently in the form of prills.

Typically, the discontinuous phase may comprise from about 20 to about 97%, more usually from 30 to 95%, and preferably from 70 to 95% by weight of the total emulsion explosive composition. The discontinuous phase may be entirely devoid of water, in the case of a melt emulsion, or may comprise relatively minor amounts of water, for example—from 2 to 30%, more usually from 4 to 25% and preferably from 8 to 18% by weight of the total composition.

The organic medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the organic medium, and although the resultant emulsion may have a substantially solid continuous phase, the organic medium should be capable of existing initially in a sufficiently fluid state, if necessary in response to appropriate temperature adjustment, to permit emulsification to proceed.

Suitable organic media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic fuel medium the continuous phase may optionally comprise a wax to control the rheology of the system. Suitable waxes include petroleum, mineral, animal, and insect waxes. The preferred waxes have melting temperatures of at least 30° C. and are readily compatible with the formed emulsion. A prefered wax has a melting temperature in a range of from about 40° C. to 75° C.

Generally, the continuous phase (including wax(es), if present) comprises from 1 to 10, and preferably from 2 to 8% by weight of the total explosive composition, but higher proportions, for example in a range of from 1 up to 15 or even 20% may be tolerated.

To be effective in suppressing or modifying growth of crystals of the oxygen-supplying (or oxidiser) salt, the inhibitor employed in the compositions of the present invention should be compatible with the discontinuous phase medium. In the generally preferred emulsion explosive compositions wherein the discontinuous phase comprises an aqueous solution of an oxidiser salt, such as ammonium nitrate, the inhibitor should therefore be at least partially, and desirably completely, soluble in the aqueous medium of the the discontinuous phase. Effectively, therefore, the inhibitor is a non-emulsifier for the explosive composition.

Although the mechanism by which the inhibitor functions is not completely understood, it is postulated that the inhibitor becomes associated with at least one of the growing crystal faces resulting from incipient crystallisation of the oxidiser salt in the discontinuous phase, thereby distorting the crystal lattice and reducing subsequent crystal growth and or modifying the crystal habit. Desirably, therefore, the inhibitor comprises a material which is soluble in a concentrated solution of the oxidiser salt, and particularly a material, such as an inorganic salt, at least some (preferably at least two) of the crystal lattice parameters of which are similar in magnitude to, but not necessarily identical with (and preferably marginally smaller than), those of the oxidiser salt. Crystal lattice parameter compatibility of this kind apparently ensures an adequate degree of association between the inhibitor and oxidiser salt to confer the desired improvement in composition storage stability.

The nature of the inhibitor will vary in accordance with the precise nature of the oxidiser salt, but a preliminary assessment of inhibitor suitability may be effected by a comparison of the X-ray diffraction patterns of potential inhibitors with that of the selected oxidiser salt.

Preferred inhibitors include chain polyphosphates (the term "chain" as herein employed including a "ring" structure), particularly those chain polyphosphates, comprising a cyclic anion of alternately interconnected oxygen and phosphorus atoms, which are commercially available as metaphosphates and believed to have a composition approximating to the general formula $(MPO_3)_n$, wherein M is a univalent cation, such as ammonium or an alkali metal (particularly lithium, sodium or potassium), or an equivalent of a multi-valent cation, such as an alkaline earth metal (particularly calcium, strontium or barium), and n is an integer—preferably greater than 4. Phosphate glasses of general formula $M_{n+2}P_nO_{3n+1}$, wherein M and n are as hereinbefore defined, are also useful chain polyphosphate inhibitors.

Most polyphosphates are of imprecise composition and occur as mixtures comprising a distribution of various chain lengths, although with increasing chain length the mixtures increasingly tend to behave as pure compounds. Preferred polyphosphates for use as inhibitors in the present invention include those of the approximate formula $(MPO_3)_n$ having a degree of polymerisation (n) of from about 6 to 30, a molecular weight of from about 600 to 3100 and an $M_2O:P_2O_5$ ratio of greater than 1.0, and preferably of from about 1.05 to 1.30. A suitable inhibitor comprises an amorphous glassy sodium phosphate, commercially available as Calgon, and having an $Na_2O:P_2O_5$ ratio of about 1.10, a molecular weight of from about 1500 to 2000 and a degree of polymerisation of from about 15 to 20, i.e. of average composition ranging from $Na_{15}P_{13}O_{40}$ to $Na_{20}P_{18}O_{55}$.

Phosphate inhibitors which are particularly suitable for use in association with an ammonium nitrate oxidiser, are of relatively low molecular weight, for example—those having a degree of polymerisation of from about 6 to 10, and a molecular weight of from about 600 to 1000. This latter category includes the cyclic chain or ring materials commercially available within the generic description "hexamethaphosphates", especially "sodium hexametaphosphate"—which is a particularly preferred inhibitor for use in the compositions of the present invention.

The hexametaphosphate anion exhibits two characteristic lattice spacings of 3.5 and 5.0 Å which, we believe, render it compatible with an oxidiser salt, such as ammonium nitrate—which exhibits characteristic lattice spacings of about 3.8 and 5.0 Å at the 001 crystal face, and of about 3.5 and 5.0 Å at the 011 crystal face. The hexametaphosphate anion is therefore adsorbed onto these faces and restricts or modifies growth of the oxidiser salt crystals.

The compositions of the invention may comprise a single inhibitor, although a mixture of two or more inhibitors may be employed, if desired.

The amount of inhibitor required in the compositions of the invention is generally small. The required amount of inhibitor is readily assessed by simple experimental trial, and is generally observed to be within a range of from 0.005 to 2.5, preferably from 0.01 to 1.0, and particularly preferably from 0.05 to 0.5% by weight of the total explosive composition. Sodium hexametaphosphate at a concentration of the order of 0.1% by weight of the total composition has been observed to yield acceptable storage characteristics in an emulsion explosive composition wherein the discontinuous phase comprises ammonium nitrate as the oxidiser salt.

Conventional oxidiser salts, such as ammonium nitrate, tend to crystallise in a needle habit, and it has been observed by optical microscopy that in addition to inhibiting crystal growth, the presence of a sodium hexametaphosphate inhibitor in accordance with the invention modifies the crystal habit so that any crystallisation of the oxidiser salt tends to occur in a substantially rounded or bipyramidal habit.

Formulation of a stable emulsion is generally effected in the presence of an emulsifier capable of promoting a relatively permanent dispersion of the discontinuous phase component(s) in the continuous phase medium. Emulsifiers hitherto employed in the production of emulsion explosive compositions have conventionally been of the water(or melt)-in-oil type which promote or facilitate the formation of an emulsion in which the discontinuous phase comprises an aqueous (or melt) medium and the continuous phase comprises an oily or organic medium. Such emulsifiers are herein described as conventional emulsifiers and are suitably employed in formulating the emulsion explosive compositions of the present invention.

Conventional emulsifiers, as hereinbefore defined, are strongly lipophilic, i.e. they exhibit a high affinity for the oily or organic medium of the continuous phase, and have a low hydrophilic-lipophilic balance (HLB). Typically, such conventional emulsifiers have HLB values of less than about 10.

Many suitable conventional emulsifiers have been described in detail in the literature and include, for example, sorbitan esters, such as sorbitan sesquioleate, sorbitan monooleate, sorbitan monopalmitate, sorbitan monostearate and sorbitan tristearate, the mono- and diglycerides of fat-forming fatty acids, soyabean lecithin and derivatives of lanolin, such as isopropyl esters of lanolin fatty acids, mixtures of higher molecular weight fatty alcohols and wax esters, ethoxylated fatty ethers, such as polyoxyethylene(4) lauryl ether, polyoxyethylene(2) oleyl ether, polyoxyethylene(2) stearyl ether, polyoxyalkylene oleyl laurate, and substituted oxazolines, such as 2-oleyl-4,4'-bis(hydroxymethyl)-2-oxazoline. Suitable mixtures of such conventional emulsifiers may also be selected for use in the compositions of the present invention.

Generally, acceptable emulsification and storage characteristics are achieved when the emulsifier comprises from 0.1 to 5, preferably from 0.2 to 4, and particularly preferably from 0.5 to 2.5% by weight of the total explosive composition. Higher proportions of emulsifier may be tolerated, excess emulsifier serving as a supplemental fuel for the composition, but, in general, economic considerations dictate that the amount of emulsifier be kept to a minimum commensurate with acceptable performance.

The emulsifier may be incorporated into the emulsification medium in conventional manner.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramide, hexamethylene tetramine nitrate, and other organic nitrates.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon, sulphur, aluminium and magnesium.

Combinations of the hereinbefore described supplementary fuel components may be employed, if desired.

The amount of supplementary fuel component(s) employed may be varied in accordance with the required characteristics of the compositions, but, in general, will be in a range of from 0 to 30, preferably from 5 to 25% by weight of the total emulsion explosive composition.

Thickening and or cross-linking agents may be included in the compositions, if desired—generally in small amounts up to the order of 10, and preferably from 1 to 5% by weight of the total explosive composition. Typical thickening agents include natural gums, such as guar gum or derivatives thereof, and synthetic polymers, particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isoprene-isobutylene, or isobutylene-ethylene copolymers. Terpolymers thereof may also be employed to modify the continuous phase, and in particular to improve the retention of occluded gases in the compositions.

Preferably, the emulsion explosive compositions of the present invention comprise a discontinuous gaseous component to reduce their density (to less than 1.5, and preferably to from about 0.8 to about 1.4 gm/cc) and enhance their sensitivity. The gaseous component, usually air, may be incorporated into the compositions of the present invention as fine gas bubbles dispersed throughout the composition, hollow particles which are often referred to as microballoons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Suitable hollow particles include small hollow microspheres of glass and resinous materials, such as phenol-formaldehyde and urea-formaldehyde. Suitable porous materials include expanded minerals, such as perlite.

The gas component is usually added during cooling such that the prepared emulsion comprises from about 0.05 to 50% by volume of gas at ambient temperature and pressure. Conveniently the occluded gas is of bubble diameter below 200 μm, preferably below 100 μm, more preferably between 20 and 90 μm and particularly between 40 and 70 μm, in proportions less than 50%, preferably between 40 and 3%, and particularly preferably between 30 and 10% by volume. Preferably at least 50% of the occluded gas will be in the form of bubbles or microspheres of 20 to 90 μm, preferably 40 to 70 μm internal diameter.

An emulsion explosive composition according to the present invention may be prepared by conventional emulsification techniques. Thus, the oxygen-supplying salt(s) together with the selected inhibitor(s) may be dissolved in the aqueous phase at a temperature above the fudge point of the salt solution, preferably at a temperature in the range of from 25° to 110° C., and a mixture, preferably a solution, of an emulsifier and organic phase is separately prepared, preferably at the same temperature as the salt solution. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

An emulsion explosive composition according to the invention may be used as such, or may be packaged into charges of appropriate dimensions.

The invention is illustrated by reference to the following Examples in which all parts and percentages are expressed on a weight basis unless otherwise stated.

EXAMPLE 1

This is a comparative Example, not according to the invention.

A mixture of ammonium nitrate (77.1 parts), and water (15.6 parts) was heated with stirring to a temperature of 75° C. to give an aqueous solution. The hot aqueous solution was added, with rapid stirring, to a solution of a conventional emulsifier, sorbitan sesquioleate (1.5 parts), in refined mineral oil (3.8 parts). Stirring was continued until a uniform emulsion was obtained. Glass microballoons (2.0 parts; grade B15/250 supplied by 3M) were added to the emulsion and thoroughly mixed therein. The composition was allowed to cool and was then packaged into conventional cylindrical paper cartridges of varying diameters. The composition, as prepared, was found to have a critical diameter of 8 mm. Cartridges of 25 mm diameter were stored at a temperature of 10° C. and were periodically tested for cap sensitivity using a standard No. 8 detonator.

After storage for 9 weeks the cartridges failed to detonate.

Optical microscopic examination of sample cartridges after storage for 9 weeks revealed evidence of ammonium nitrate crystal formation, the crystals being of needle habit, although some approximately spherical crystals and agglomerates were also detected.

EXAMPLE 2

The procedure of Example 1 was repeated, save that into the oxidiser solution comprising ammonium nitrate (77.0 parts) and water (15.6 parts) was incorporated sodium hexametaphosphate (0.1 part; supplied by BDH Ltd) as an inhibitor.

The composition, as prepared had a critical diameter of 8 mm.

Cartridges of 25 mm diameter formed and tested in the manner of Example 1 were still cap sensitive after storage for 18 weeks at a temperature of 10° C.

Optical microscopic examination of specimen cartridges stored for 18 weeks at a temperature of 10° C., revealed some evidence of ammonium nitrate crystal formation, the crystals being essentially of a rounded bipyramidal habit.

A solution of sodium hexametaphosphate (1.0% by weight) in water was observed to exhibit a surface tension of 72 dynes $cm^{-1}$ in air at a temperature of 25° C., i.e. substantially identical to that of pure water indicating that the sodium hexametaphosphate inhibitor is totally inactive at liquid-liquid interfaces and does not function as an emulsifier for the explosive composition.

EXAMPLE 3

The procedure of Example 2 was repeated save that the sodium hexametaphosphate inhibitor was replaced by a phosphate glass (0.1 part) of average composition between $Na_{15}P_{13}O_{40}$ and $Na_{20}P_{18}O_{55}$, supplied by Sigma.

Cartridges of 25 mm diameter formed and tested in the manner of Example 1 were still cap sensitive after storage for 13 weeks at a temperature of 10° C.

After storage for 13 weeks, evidence of bipyramidal ammonium nitrate crystal formation was apparent.

EXAMPLES 4 TO 6

These are comparative Examples not according to the invention.

The procedure of Example 2 was repeated save that the sodium hexametaphosphate inhibitor was replaced respectively by 0.1 part of each of sodium carboxymethyl cellulose (supplied by Hercules Ltd), sodium alginate (supplied by BDH Ltd) and acid fuchsin (supplied by BDH Ltd).

Cartridges of 25 mm diameter formed and tested in the manner of Example 1 became cap-insensitive and failed to detonate after relatively short periods of storage at a temperature 10° C., as indicated in the following Table.

| Example | Inhibitor | Failure Time (weeks) |
|---|---|---|
| 4 | sodium carboxymethyl cellulose | 9 |
| 5 | sodium alginate | 6 |

-continued

| Example | Inhibitor | Failure Time (weeks) |
|---|---|---|
| 6 | acid fuchsin | 9 |

Crystal habit modification i.e. formation of a significant proportion of ammonium nitrate crystals of rounded-bipyramidal habit was observed in Examples 4 and 6.

EXAMPLE 7

This is also a comparative Example, not according to the invention.

The procedure of Example 1 was repeated save that the sorbitan sesquioleate conventional emulsifier was replaced by another conventional emulsifier, 2-(8-heptadecenyl)-4,4-bis(hydroxymethyl)-2-oxazoline (1.5 parts; supplied by IMC Chemie GmbH under the Trade Name 'Alkaterge' T). The oxidiser salt solution, as in Example 1, comprised ammonium nitrate (77.1 parts) and water (15.6 parts) without the addition of an inhibitor.

Cartridges of 25 mm diameter formed and tested in the manner of Example 1 failed to detonate after storage for 6 weeks at a temperature of 10° C.

EXAMPLE 8

The procedure of Example 7 was repeated, save that into the oxidiser solution comprising ammonium nitrate (77.0 parts) and water (15.6 parts) was incorporated sodium hexametaphosphate (0.1 part) as an inhibitor.

Cartridges of 25 mm diameter formed and tested in the manner of Example 1 were still cap sensitive after storage for 10 weeks at a temperature of 10° C., i.e. an improvement in storage time of more than 66% compared with the control sample containing no inhibitor (Example 7).

EXAMPLE 9

The procedure of Example 2 was repeated save that the sodium hexametaphosphate inhibitor was replaced by potassium hexametaphosphate (0.1 part ).

Cartridges of 25 mm diameter formed and tested in the manner of Example 1 were still cap sensitive after storage for 20 weeks at a temperature of 10° C.

EXAMPLE 10

The procedure of Example 2 was followed except the refined mineral oil (3.8 parts) was replaced by a mixture of refined mineral oil (1 part), paraffin wax (1.3 parts) and microcrystalline wax (1.5 parts).

Cartridges of 25 mm diameter formed and tested as in Example 1 were still cap sensitive after storage for 45 weeks at a temperature of 10° C.

We claim:

1. An emulsion explosive composition comprising a discontinuous phase containing an oxygen-supplying salt component and an organic medium forming a continuous phase wherein the discontinuous phase additionally comprises an inhibitor capable of at least partially restricting growth and modifying the habit of crystals of the oxygen-supplying salt component.

2. A composition according to claim 1 wherein the discontinuous phase comprises an aqueous medium.

3. A composition according to claim 1 wherein the inhibitor comprises an inorganic salt at least some of the crystal lattice parameters of which are of similar magnitude to those of the oxygen supplying salt.

4. A composition according to claim 1 wherein the inhibitor comprises a chain polyphosphate.

5. A composition according to claim 4 wherein the inhibitor comprises a chain polyphosphate approximating to the general formula $M_{n+2}P_nO_{3n+1}$, wherein:

M is a univalent cation or an equivalent of a multivalent cation, and n is an integer of from 6 to 30, preferably from 13 to 18.

6. A composition according to claim 4 wherein the inhibitor comprises a chain polyphosphate approximating to the general formula $(MPO_3)_n$, wherein:

M is a univalent cation or an equivalent of a multivalent cation, and n is an integer of greater than 4, and preferably of from 6 to 30.

7. A composition according to claim 4 wherein the chain polyphosphate has an $M_2O:P_2O_5$ ratio of greater than 1.0, and preferably of from 1.05 to 1.30.

8. A composition according to claim 4 wherein the inhibitor comprises sodium hexametaphosphate.

9. A process for producing an emulsion explosive composition comprising emulsifying an oxygen-supplying salt component and an organic medium in the presence of an emulsifier to form an emulsion in which the salt forms at least part of the discontinuous phase and the organic medium forms at least part of the continuous phase wherein the discontinuous phase additionally comprises an inhibitor capable of at least partially restricting growth and modifying the habit of crystals of the oxygen-supplying salt component.

10. An cartridge comprising an emulsion explosive composition according to claim 1 or prepared by a process according to claim 9.

11. An emulsion explosive composition comprising a discontinuous phase containing an oxygen-supplying salt component and an organic medium forming a continuous phase wherein the discontinuous phase additionally comprises an inhibitor capable of at least partially restricting growth and/or modifying the habit of crystals of the oxygen-supplying salt component, said inhibitor comprising a chain polyphospate approximating to a general formula selected from $M_{n+2}P_nO_{3n+1}$ and $(MPO_3)_m$, wherein:

M is a univalent cation or an equivalent of a multivalent cation, n is an integer of from 6 to 30, and m is an integer of greater than 4.

12. An emulsion explosive composition as set forth in claim 11 in which m is from 6 to 30.

13. An emulsion explosive composition according to claim 11 wherein the inhibitor comprises an amorphous glassy sodium phosphate of average composition ranging from $Na_{15}P_{13}O_{40}$ to $Na_{20}P_{18}O_{55}$.

* * * * *